US005154648A

United States Patent [19]

Buckshaw

[11] Patent Number: 5,154,648

[45] Date of Patent: Oct. 13, 1992

[54] TUBE SHIELD

[76] Inventor: Dennis J. Buckshaw, 42240 Crestview, Northville, Mich. 48167

[21] Appl. No.: 749,542

[22] Filed: Aug. 23, 1991

[51] Int. Cl.[5] ..... F28F 19/00

[52] U.S. Cl. ..... 165/134.1; 122/DIG. 13

[58] Field of Search ..... 122/511, DIG. 13; 165/134.1; 138/110

[56] References Cited

U.S. PATENT DOCUMENTS

| | | | |
|---|---|---|---|
| 1,942,211 | 1/1934 | Hartwig | 165/134.1 |
| 2,646,818 | 7/1953 | Bimpson | 165/134.1 X |
| 3,318,374 | 5/1967 | Block | 165/134 |
| 3,850,146 | 11/1974 | Graham et al. | 122/6 A |
| 3,999,600 | 12/1976 | Bell | 165/78 |
| 4,619,314 | 10/1986 | Shimoda | 165/104.16 |
| 4,667,733 | 5/1987 | Bessouat et al. | 165/134.1 |
| 4,682,568 | 7/1987 | Green et al. | 122/DIG. 13 |
| 4,776,790 | 10/1988 | Woodruff | 432/233 |
| 4,809,645 | 3/1989 | Fournier et al. | 122/6 A |

OTHER PUBLICATIONS

Helmick Corporation Brochure, "Eliminate boiler and condenser tube failure with Helmick Tube Shields" (2 pp.).

*Primary Examiner*—Edward G. Favors
*Attorney, Agent, or Firm*—Krass & Young

[57] ABSTRACT

A tube shield for protecting the tubes of heat exchangers, such as boilers and condensers, from hostile elements. The tube shield includes an axially elongated arcuate protector member and a plurality of spring clips secured to the axial free edges of the protector member at spaced locations along the length of the protector member. The spring clips are sized and configured such that they splay outwardly as the protector member is pressed downwardly over an associated tube to pass the maximum diameter of the tube and thereafter move inwardly in a spring biased manner to bitingly engage the exposed portion of the tube to preclude inadvertent separation of the protector from the tube.

13 Claims, 2 Drawing Sheets

22
18
20
20b
20b
20a
18
20c 18
20c
14c
14

20d
18
20
24
22
22

22a
22
22d
22b
22c
22f
22e 14c
20
20d
18
14a
14e
22
22
14c
14b
14
14d

TUBE SHIELD

FIELD OF THE INVENTION

This invention relates to tube shields and more particularly to shields for use in protecting the tubes of heat exchangers, such as boilers and condensers, from hostile elements.

BACKGROUND OF THE INVENTION

Tubes are in common use in various heat exchanger apparatuses such for example as boilers and condensers. The tubes employed in the boiler are commonly exposed to hostile elements such as fly ash. These hostile elements can have the effect of abrading and corroding the tubes with the result that the tubes experience early failure resulting in major maintenance and significant boiler down-time costs.

Many devices have been devised to protect the tubes from the hostile elements. In one such protective device, the shield includes an axially elongated protector member of arcuate cross section sized to fit over the tube to protect the portion of the tube embraced between the axial free edges of the member and straps are welded to the axial free edges of the member after the member has been fitted over the tube to maintain the protector in its protective position around the tube. Whereas this protective device has seen considerable usage, it suffers from the disadvantage that it requires shop labor to weld the straps between the axial free edges of the protector and, further, the welding in the vicinity of the tube may have the effect of altering the chemistry of the tube with resultant metal fatigue. In another such protective device, also involving an axially elongated protector member of arcuate cross section, the axial free edges of the protector member are rolled radially outwardly and the inner surfaces of the rolled edges are spaced apart a distance less than the diameter of the tube to be protected so that the protector member may be snapped in place over the tube with the rolled axial free edges of the protector member engaging the tube to inhibit separation of the protector member from the tube. Whereas this device has also seen considerable usage, it suffers from the disadvantage that the radially outwardly rolled free edges of the protector member extend into the flow path between adjacent tubes so as to interfere with gas flow between adjacent tubes and, further, the rolled free edges, in order to have the required spring action to retain the protector member on the tube, must be relatively thick and this thickness of necessity must be carried through the entire protector member with the result that the protector member is heavier and more expensive than it need otherwise be to perform its protective function.

SUMMARY OF THE INVENTION

This invention is directed to the provision of an improved tube shield for use in connection with heat exchanger tubes.

More specifically, this invention is directed to the provision of a tube shield which is inexpensive, durable, and readily applied to the associated tube.

The tube shield of the invention is of the type including an axially elongated protector member of arcuate cross section sized to fit over the tube to protect the portion of the tube embraced between the axial free edges of the member. The invention tube shield is characterized in that the shield includes at least one spring clip secured to each free edge of the protector member sized and configured to bitingly engage a point on the exposed portion of the tube. This arrangement provides a simple and inexpensive means of retaining the protector member on the tube.

According to a further feature of the invention, each clip has a free resilient end, the clips are sized to bitingly engage points on the exposed surface of the tube lying on a chord of the tube, and the clips have a relaxed configuration in which the free end of a clip on one axial edge of the protector member is spaced from the free end of a clip on the other axial edge of the protector member by a distance less than the length of the chord. This arrangement allows the clips to be splayed apart to pass over the widest dimension of the tube whereafter the free ends of the clips move radially inwardly to bitingly and securely engage the exposed surface of the tube.

According to a further feature of the invention, each clip comprises a strip of spring material defining the free biting end at one end thereof, secured at its other end to a respective free axial edge of the protector member, and having a curvilinear configuration between its ends. This arrangement allows each clip to extend in cantilever fashion from the respective axial edge of the protector member so as to allow the free end of the clip to resiliently and bitingly engage the exposed portion of the tube.

According to a further feature of the invention, the clips are welded at their one ends to the free axial edge of the protector member. This arrangement allows the shields to be totally fabricated in a manufacturing environment with resultant savings in shop labor and further avoids the necessity of performing welding operations adjacent the tubes with consequent potential derogation to the tubes.

DETAILED DESCRIPTION OF THE PREFERRED EMBODIMENT

Figure 1:
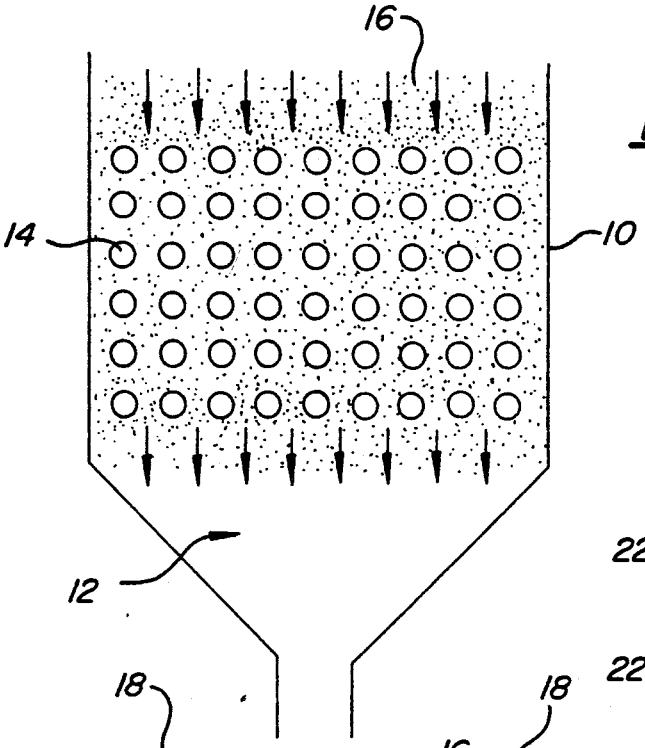
FIG. 1 is a view of a portion of a boiler employing vertical rows of tubes to perform a heat exchanger function within the boiler.
Figure 8:
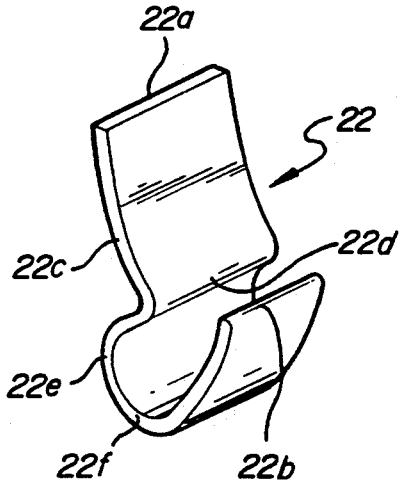
FIG. 8 is a perspective view of the spring clip of FIG. 7.

The apparatus illustrated in FIG. 1 may form a portion of a boiler or condenser and includes a housing 10 defining a chamber 12 within which vertical rows of tubes 14 are suitably positioned. The tubes are exposed to hostile elements as they perform their heat exchanger function such for example as fly ash 16 moving downwardly between the vertical rows of tubes. It will be understood that the fly ash results from the combustion of coal in an earlier stage of the overall boiler function. The tubes, if left exposed to the fly ash over an extended period of time, would gradually abrade and corrode. It is necessary therefore to protect the tubes from the hostile elements such as the fly ash 16.

The tubes are shielded from the fly ash 16 by the use of tube shields 18 constructed and utilized in accordance with the invention.

Each tube shield 18 includes a protector member 20 and a plurality of spring clips 22.

Each protector member 20 is axially elongated and has an arcuate cross section so as to define an arcuate main body portion 20*a*, axially extending free edges 20*b*, and arcuate end edges 20*c*. Main body portion 20*a* is formed on a radius generally corresponding to the radius of the tube 14 to be shielded and extends through an included angle of at least 180° so that the protector member, when placed over the associated tube, embraces and protects at least 180° of the tube and leaves exposed a maximum of 180° of the tube.

In a preferred embodiment, the protector member defines an included angle of approximately 220° between the axial free edges 20*b* so that only 140° of the associated tube is left exposed when the protector member is in its embracing, protective position over the tube. The protector member 20 may be formed, depending on the particular application, of a variety of ferrous materials ranging anywhere from a 304 series Stainless Steel to a very high nickel content stainless steel available under the trade name INCONEL. Protective member 20 may have a thickness for example of, between 1/16 and ⅛ inch and a length of two feet. It will be understood that a plurality of protector members 20 would be placed end to end over an associated tube 14 to protect a tube having a length in excess of two feet.

Each spring clip 22 has a first linear end edge portion 22*a* for securement to a respective axial free edge of the protector member; a free linear end edge 22*b* for biting engagement with the exposed portion of the associated tube, and portions 22*c*, 22*d*, 22*e* and 22*f* interconnecting ends 22*a* and 22*b* to define a compound curvilinear configuration between the end edges. It will be seen that portions 22*a, c, d, e, f*, and *b* define a hook shaped configuration for the clip in side edge profile and are arranged such that, with the end edge 22*a* secured to a respective axial free edge of the protector member, the free end edge 22*b* is arranged in cantilever fashion relative to the secured end and may move resiliently and in a generally radial direction relative to the embraced tube to bitingly engage the exposed surface of the tube.

Each clip 22 may be formed for example of a suitable ferrous material ranging from a relatively inexpensive 304 series stainless steel to a high nickel content stainless steel such as INCONEL. Each clip preferably has a thickness of between ⅛ and ¼ inch. The clip typically has a thickness greater than the thickness of the protector member 20 so as to impart the required spring strength to the clips without penalizing the protector member and requiring the protector member to be unduly heavy and expensive. For example, a protector member having a thickness of 1/16 inch may be used in combination with clips having a thickness of ⅛ inch and a protector member having a thickness of ⅛ inch may be used in combination with clips having a thickness of ¼ inch.

The clips are secured to the axial free edges 20*b* of the protector member by welding the end portion 22*a* of each clip to the adjacent surface of the protector member proximate the respective free edge 20*b*. End portions 22*a* may be disposed on the outer surface of the protector member or, as shown, may be disposed on the inner surface of the protector member with the end portion 22*a* arranged in lapped fashion with respect to the adjacent portion of the protector member to provide an adequate weld interface between the clip and the protector member.

Figures 3, 4, 5, 6, 7:
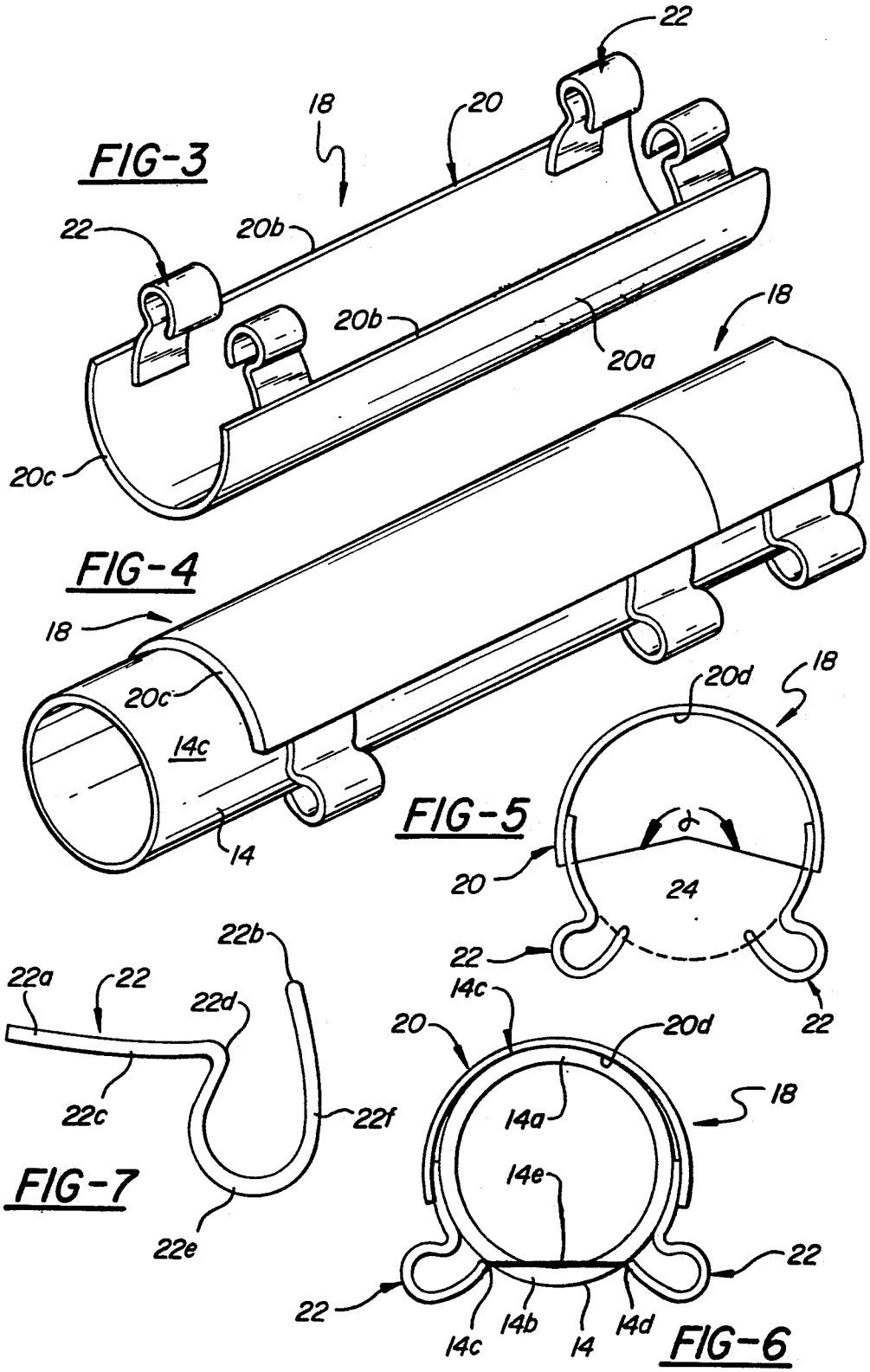
FIG. 3 is a perspective view of a tube shield according to the invention.
FIG. 4 is a perspective view of an invention tube shield shown embracing a tube.
FIG. 5 is an end view of a tube shield according to the invention.
FIG. 6 is an end view of an invention tube shield shown embracing a tube.
FIG. 7 is an edge view of a spring clip employed in the invention tube shield.

As best seen in FIGS. 5 and 6, the tube shields 18 are applied to the associated tube 14 by pressing the shield over the tube with the spring clips 22 splaying outwardly to pass over the maximum diameter of the tube and then moving resiliently inwardly, as the protector member 20 moves into any embracing position with respect to the upper portion 14*a* of the tube, into biting engagement with points on the exposed portion 14*b* of the tube.

Specifically, the end edges 22*b* of confronting clips 22 move into biting engagement with points 14*c* and 14*d* on the exposed surface 14*b* of the tube to preclude inadvertent separation of the shield from the tube. With continued reference to FIGS. 5 and 6, it will be seen that, with the tube shield in its relaxed configuration disassociated from a tube, the end edges 22*b* are contained within the circle 24 defining the radially inner surface 20*d* of the protector member (and the radially outer surface 14*c* of the tube) so that the end edge 22*b* on one clip is spaced from the end edge 22*b* on the confronting clip by a distance less than the length of the cord 14*e* connecting the points 14*c* and 14*d* on the exposed surface 14*b* of the tube 14. Thus, when the tube shield is applied to the tube in protective fashion, the end edges 22*b* of the clips are pressed resiliently and bitingly into the surface of the exposed portion of the tube to positively lock the shield to the tube.

The mounting and configuration of each clip is such that the end portion 22*f* of the clip is generally radially disposed with respect to the circle 24 so that the movement of the free end edge 22*b* of the clip between its relaxed position of FIG. 5 and its outwardly biased positions is generally radial with respect to the circle 24. This arrangement allows the clip to pass readily over the tube to mount the protector member on the tube and ensures a firm biting engagement with the tube in the mounted position of the protector member.

As best seen in FIG. 3, the clips 22 are preferably provided in opposed pairs with each pair consisting of a clip on one free edge 20*b* confronting a clip on the other free edge 20*b*. As further seen in FIG. 3, a plurality of clips are provided along each free edge 20*b* so as to provide a plurality of clip pairs at axially spaced locations along each protector member. For example, as shown, for a two foot long protector member two pairs of clips 22 may be provided with one clip pair proximate each end of the protector member. Further pairs would of course be provided for longer protector members.

Figure 2:
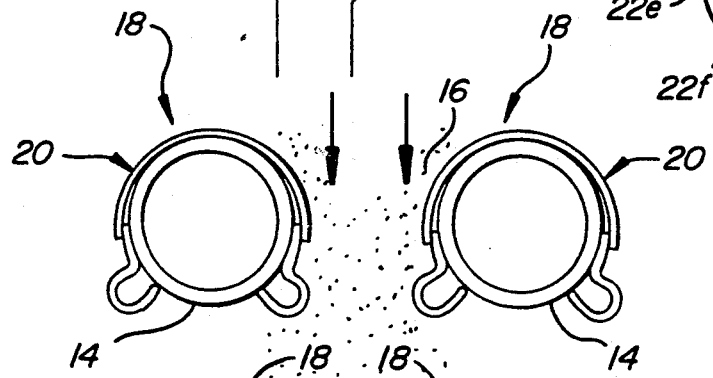
FIG. 2 is a view showing the invention tube shield installed in association with adjacent vertical rows of tubes.
Figure 2:
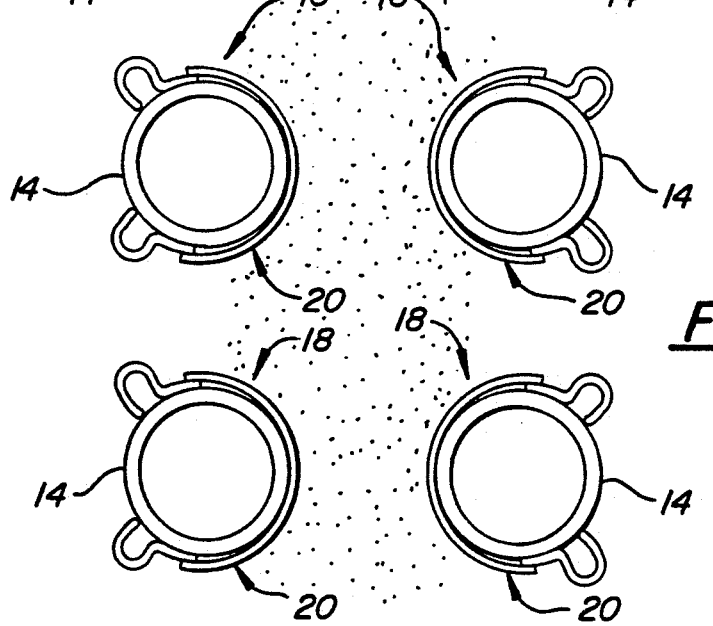

As will be apparent, the invention tube shield is selectively applied to the portions of tubes 14 where protection is required or desired. For example, in the tube arrangement seen in FIG. 2, including two vertical rows of tubes 14, shields 18 may be snappingly applied over the upper portions of the tubes 14 in the upper row while shields 18 may be applied to the confronting inboard side portions of the tubes 14 in lower rows since the fly ash 16 will impact generally on the upper portion of the tubes 14 in the upper row and will impact primarily on the side portions of the tubes 14 in the lower rows as the fly ash moves downwardly between the vertical rows. Other tube arrangements will of course require different applications of the tube shields 18 to provide the required or desired protection for the associated tubes.

The invention tube shield will be seen to provide many important advantages as compared to prior art shields. Specifically, the invention shields are extremely simple in construction and extremely inexpensive; the invention shields may be readily applied to selected portions of selected tubes to provide the required and desired protection; the tube shields, once applied, are positively retained in their embracing position with respect to the tubes; the attaching means for the tube shields, in the mounted position of the tube shields on the tubes, do not interfere with gas flow between adjacent rows of tubes; since the clips are formed independently of the protector member the clip thickness may be chosen to maximize the spring strength of the clips while allowing thinner stock to be utilized for the protector members so as to minimize weight and cost; and the manufacturing requirements to assemble the tube shields to the tubes may be performed in a manufacturing environment rather than requiring on site labor with resultant costs and potential damage to the associated tubes.

Whereas a preferred embodiment of the invention has been illustrated and described in detail, it will be apparent that various changes may be made in the disclosed embodiment without departing from the scope or spirit of the invention.

I claim:

1. A tube shield of the type including an axially elongated protector member of arcuate cross section sized to fit over the tube to protect the portion of the tube embraced between the axial free edges of the member, characterized in that the shield includes at least one spring clip secured to each axial free edge of the protector member, each clip has a free resilient flexible end, the clips are sized to bitingly engage points on the exposed surface of the tube lying on a chord of the tube, and the clips have a relaxed configuration in which the free end of a clip on one axial edge of the member is spaced from the free end of a clip on the other axial edge of the member by a distance less than the length of the chord.

2. A shield according to claim 1 wherein each shield comprises a strip of spring material defining said free flexible end at one end thereof, secured at its other end to a respective free axial edge of the protector member, and having a curvilinear configuration between its ends.

3. A shield according to claim 2 wherein each clip has a compound curvilinear configuration between its ends.

4. A shield according to claim 1 wherein a plurality of clips are provided at axially spaced locations along each axial free edge of the protector member.

5. A shield according to claim 4 wherein said clips are arranged in pairs with a clip on one axial edge confronting a clip on the other axial edge.

6. A shield according to claim 2 wherein said other end of each clip is secured to the respective free axial edge of the protector member by welding.

7. A tube shield comprising:

an axially elongated protector member of arcuate cross section having opposite axially extending free edges defining an included angle of at least 180° therebetween so as to embrace at least 180° of the tube when positioned over the tube; and at least one spring clip secured to each free edge of the protector member sized and configured to bitingly engage an exposed portion of the tube;

each spring clip including a first end portion secured to the protector member and a second end portion extending circumferentially beyond the respective free edge of the protector member to define a free end edge for biting engagement with the tube.

8. A tube shield comprising:

an axially elongated protector member of arcuate cross section having opposite axially extending free edges defining an included angle of at least 180° therebetween so as to embrace at least 180° of the tube when positioned over the tube; and at least one spring clip secured to each free edge of the protector member sized and configured to bitingly engage an exposed portion of the tube;

each clip comprising a strip of spring material secured at one end thereof to a respective axially edge of the protector member and extending from said one end thereof in cantilever fashion to define a resilient free end for biting engagement with the exposed portion of the tube.

9. A shield according to claim 8 wherein each clip has a curvilinear configuration between its ends.

10. A shield according to claim 9 wherein each strip has a compound curvilinear configuration between its ends.

11. A tube shield comprising:

an elongated protector member of arcuate cross section with its radially inner surface lying essentially on a circle and having opposite axially extending free edges defining an included angle therebetween of at least 180°; and at least one spring clip secured to each free edge of the protector member with each clip secured to the respective free edge at one end thereof and having a free end edge disposed within the circle with the clip in a relaxed configuration.

12. A tube shield according to claim 11 wherein each clip comprises a strip of spring material secured at one end to a respective free edge of the protector member and extending from the free edge of the protector member in cantilever fashion and the portion of the strip proximate the free end edge thereof is disposed generally radially with respect to the circle.

13. A tube shield according to claim 12 wherein the strip has a compound curvalinear configuration between its secured end and its free end edge.

* * * * *